US007136615B2

(12) United States Patent
Oohara et al.

(10) Patent No.: US 7,136,615 B2
(45) Date of Patent: Nov. 14, 2006

(54) HEAT FIXING UNIT WITH IMPROVED BELT HANDLING

(75) Inventors: Shunjchi Oohara, Ushiku (JP); Tetsuji Takegoshi, Hitachiota (JP); Toshio Ogiso, Hitachi (JP); Shigeru Obata, Ishioka (JP); Kenji Asuwa, Toride (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 44 days.

(21) Appl. No.: 10/951,048

(22) Filed: Sep. 22, 2004

(65) Prior Publication Data

US 2005/0129431 A1 Jun. 16, 2005

(30) Foreign Application Priority Data

Dec. 10, 2003 (JP) ..... 2003-411163

(51) Int. Cl.
*G03G 15/20* (2006.01)

(52) U.S. Cl. ..... 399/329; 399/328

(58) Field of Classification Search ..... 399/329, 399/122

See application file for complete search history.

(56) References Cited

U.S. PATENT DOCUMENTS 5,765,086 A * 6/1998 Kishino et al. ..... 399/329
6,647,227 B1 * 11/2003 Yokoi et al. ..... 399/112
6,907,221 B1 * 6/2005 Tanino et al. ..... 399/329
2002/0146259 A1 * 10/2002 Zhou et al. ..... 399/329
2003/0103788 A1 * 6/2003 Yura et al. ..... 399/329

FOREIGN PATENT DOCUMENTS

JP 05-127551 5/1993
JP 06003982 A * 1/1994

OTHER PUBLICATIONS

Machine translation of Japanese patent JP06003982.*

* cited by examiner

*Primary Examiner*—David M. Gray
*Assistant Examiner*—Ruth N. LaBombard
(74) *Attorney, Agent, or Firm*—Townsend and Townsend and Crew LLP

(57) ABSTRACT

A fixing unit that is provided in an image forming device and fixes a toner image transferred to paper is constructed of two belts, belt guides each of which guides the inner periphery of each of the belts, a heating member arranged in one of the belts or heating members arranged in both of the belts, a drive roller for driving the inner periphery of the belt, wherein the belts pinch paper on both surfaces thereof by the belt guides and carry the paper. This construction can realize a fixing unit reduced in size and capable of printing images at high speeds and shortening a rise time that elapses until the fixing unit reaches a fixable temperature.

21 Claims, 5 Drawing Sheets

HEAT FIXING UNIT WITH IMPROVED BELT HANDLING

CLAIM OF PRIORITY

The present application claims priority from Japanese application serial JP 2003-411163 filed on Dec. 10, 2003, the content of which is hereby incorporated by reference into this application.

BACKGROUND OF THE INVENTION

The present invention relates to a fixing unit for fixing a toner image on a recording medium in an electrophotography device.

As disclosed in Japanese Patent Laid-Open No. H5(1993)-127551, a fixing unit is proposed that includes a belt looped over a drive roller and a driven roller and a belt looped over a pair of rollers each of which is pressed via the former belt onto each of the drive roller and the driven roller.

When a belt is used for a fixing unit in an electrophotography type image forming device using toner, the width of nip where paper is pinched and heated can be elongated in the carrying direction. For this reason, even if the carrying speed of the paper is increased, toner can be heated for a sufficient time and hence a recording speed can be increased. In a fixing unit using a belt, there is a construction in which nip is defined by a roller and a belt. In this construction, the paper and the belt can be carried by the roller, which can simplify a drive mechanism. However, to widen the width of nip, an angle formed by a belt looped over the roller needs to be increased, which increases the degree of curl of paper along the roll. To decrease this angle to decrease the degree of curl, the diameter of the roller needs to be increased, which increases the size of the fixing unit and increases heat capacity to increase a rise time that elapses until the belt reaches a fixable temperature. In the case where both parts to define the nip are belts, the problem of curl can be eliminated but a force that presses toner onto the paper at the nip defined by the belts opposed to each other becomes weak. For this reason, to increase a fixing capability, the width of the nip needs to be further elongated as compared with a case where one of the parts to define the nip is a roller. Further, to drive and carry the belt, at least two rollers for each of the belts, that is, a total of four rollers need to be provided. This makes the construction of the fixing unit complex and elongates a rise time that elapses until the belt reaches a fixable temperature.

OBJECT AND SUMMARY OF THE INVENTION

The object of the invention is to provide a fixing unit that is small in size and can print images at high speeds and can shorten a rise time to a fixable temperature and an image forming device using the same.

The invention is: in a fixing unit including: two belts; belt guides each of which is arranged on an inner periphery side of each of the belts and guides an inner periphery of each of the belts; a heating member arranged in one of the belts or heating members arranged in both of the belts; a drive roller that is arranged on an inner periphery side of one of the belts and drives the belt; and a driven roller that is arranged on an inner periphery side of the other belt and transfers a driving force of the drive roller to the other belt, wherein each of the belt guides is formed in a shape in which a paper pinching side and a side opposite to the paper pinching side of each of the belt guides come into contact with the inner periphery of each of the belts, and wherein the paper pinching side of each of the belt guides is formed nearly in a flat plane shape.

The invention is: in an image forming device in which a plurality of developing units are arranged in layers on a surface nearly in a vertical direction of a photosensitive belt looped under a tension in a longitudinal direction, in which an intermediate transfer belt is arranged in such a manner as to abut against a surface opposite to the developing units of the photosensitive belt, in which a transfer roller is arranged at a position opposite to the photosensitive belt of the intermediate transfer belt, and in which a color toner image on the intermediate transfer belt is transferred to paper by the transfer roller, and having a fixing unit that passes the paper having the toner image transferred thereto to fix the toner image on the paper, wherein the fixing unit includes: two belts; belt guides each of which guides an inner periphery of each of the belts; a heating member arranged in one of the belts or heating members arranged in both of the belts; and a drive roller that drives one of the belts, the belts pinching the paper on both surfaces by the belt guides and carrying the paper.

According to the invention, it is possible to realize a fixing unit that is small in size and can print images at high speeds and can shorten a rise time to a fixable temperature and an image forming device using the same.

DESCRIPTION OF THE EMBODIMENTS

Hereafter, the constructions of a fixing unit and an image forming device of the invention will be described by the use of the drawings.

(Embodiment 1)

Figure 1:
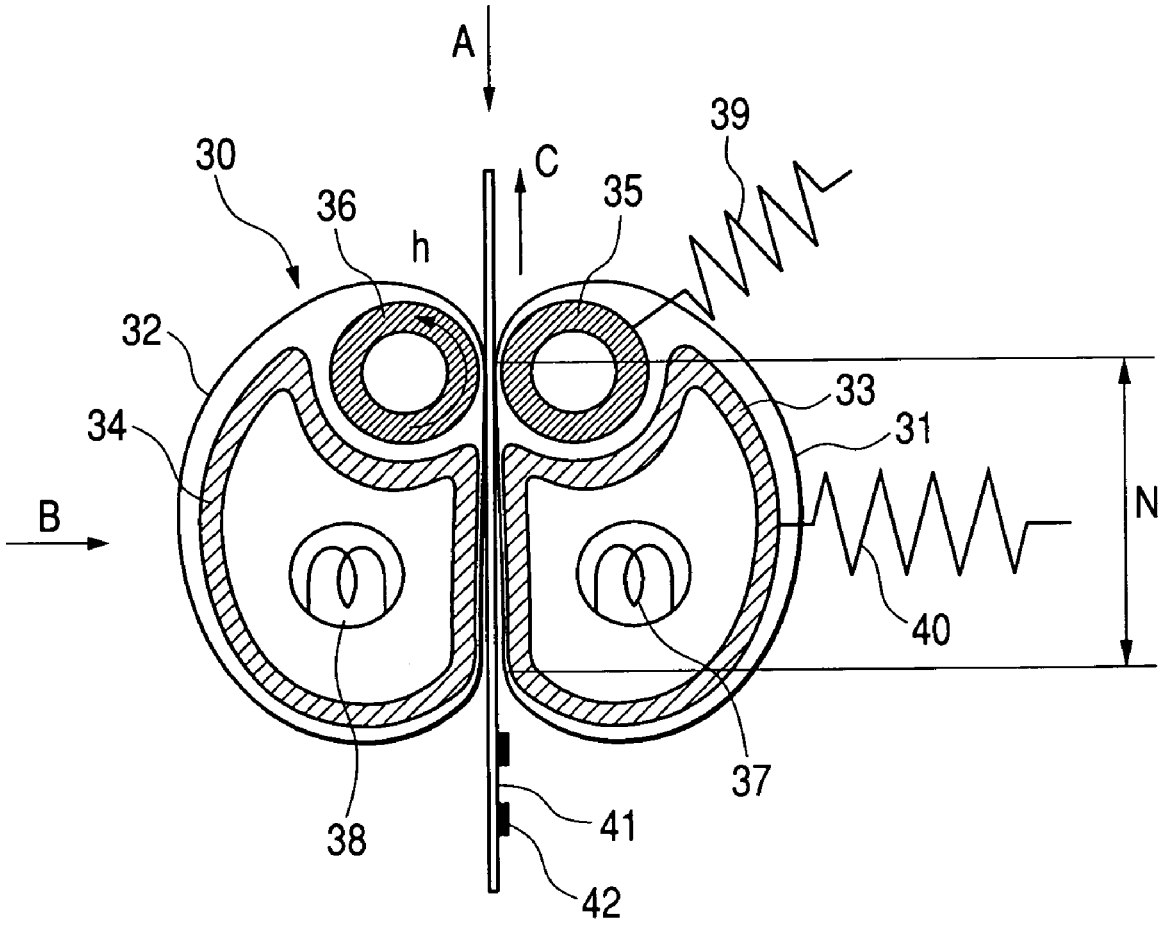
FIG. 1 is a sectional view of a fixing unit of the first embodiment of the invention.

FIG. 1 is a sectional view of one embodiment of a fixing part in a fixing unit of the invention.

A fixing unit 30 is constructed of a first belt 31 and a second belt 32 each of which is made of heat-resistant resin such as polyimide, a first belt guide 33 and a second belt guide 34 each of which guides each belt by its inner periphery without applying tension, and a first roller 35 and a second roller 36 each of which carries each belt. Each of the belt guides 33, 34 is formed in such a shape as to come into contact with the nearly whole inner periphery of the belt 31 or 32 except for the portion of the first roller 35 or the second roller 36. That is, the outer periphery of section of the belt guide is formed nearly in such a shape that an ellipsoid is cut in half and in such a shape that portions opposite to the first and second rollers 35, 36 have an arc-shaped depressions larger than the diameter of the roller so as not to interfere with the rotation of the respective rollers 35, 36. Further, a paper pinching portion of each of the belt guides 33, 34 is formed in a flat plane. In this manner, each of the first belt guide 33 and the second belt guide 34 has a construction in which a paper pinching side is formed in a flat plane shape, in which a side opposite to the paper pinching side is formed nearly in an ellipsoid shape, and in which the belt is put into contact with the inner periphery of the belt except for a portion opposite to the roller. This construction can realize a belt fixing unit having an excellent fixing capability and reduced in size.

A first heater 37 and a second heater 38 that heat the respective belts 31, 32 are arranged in the respective belt guides 33, 34. It is preferable that the respective belt guides 33, 34 are formed of metal having an excellent thermal conductivity such as aluminum. Further, the second roller 36 is fixed to the case (not shown) of the fixing unit so as not to move except in the rotational direction h and a drive motor and the like is coupled to the shaft of the roller 36 to move paper in direction C from exit portion h. That is, the second roller 36 is a drive roller. The first roller 35 is pressed via the respective belts onto the second roller 36 by roller pressing springs 39 provided on the first roller 35. The first belt guide 33 is pressed via the respective belts 31, 32 onto the second belt guide 34 by belt guide pressing springs 40. The first roller 35 is a driven roller.

Figure 2:
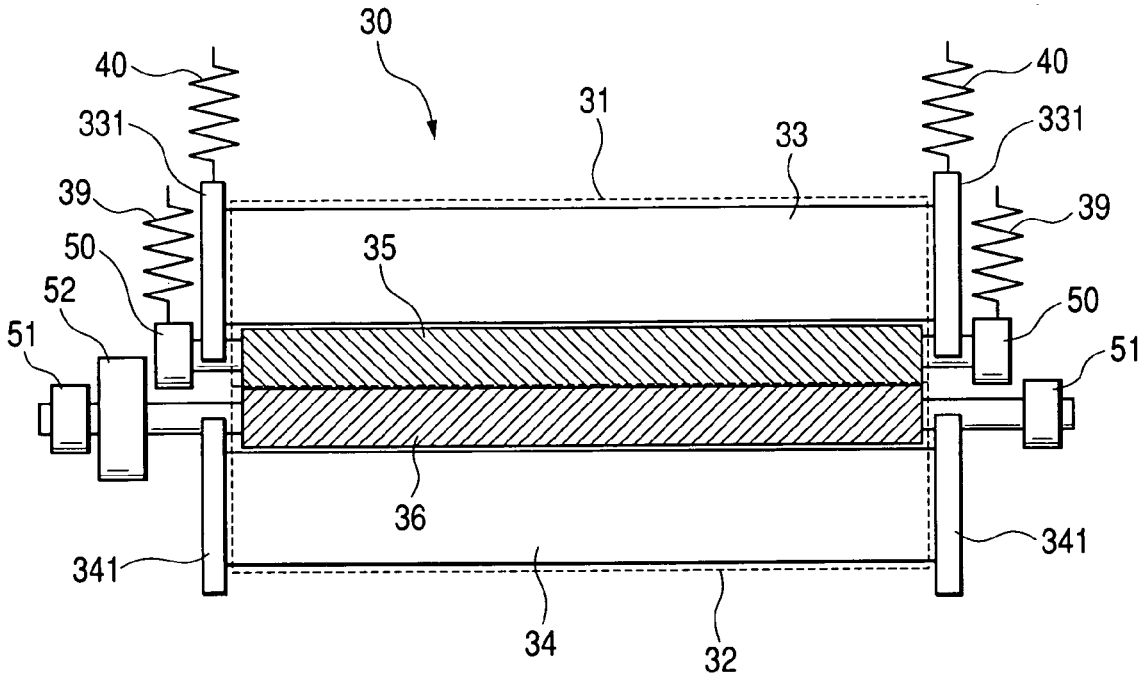
FIG. 2 is the fixing unit when viewed from the direction of arrow A in FIG. 1.
Figure 3:
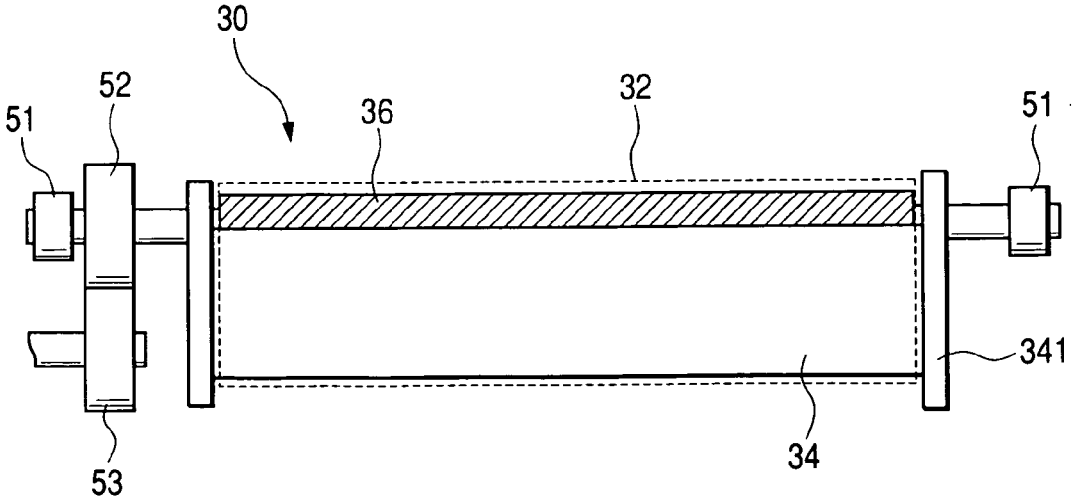
FIG. 3 is the fixing unit when viewed from the direction of arrow B in FIG. 1.

FIG. 2 is the fixing unit when viewed from a direction of arrow A in FIG. 1 and FIG. 3 is the fixing unit when viewed from a direction of arrow B in FIG. 1.

The outside shapes of the first belt 31 and the second belt 32 are shown by a dotted line. One end sides of a pair of roller pressing springs 39 are fixed to the case of the fixing unit 30, respectively, and the other end sides are mounted on a first roller bearing 50 parts, respectively. The first roller 35 is pressed onto the second roller 36 by this pair of roller pressing springs 39. Second roller bearings 51 are mounted on the case of the fixing unit 30. A gear 52 is mounted on one side of the rotary shaft of the second roller 36 and a driving force is transmitted via a gear 53 to the second roller 36 by a driving motor (not shown). The surface of the second roller 36 to become a drive roller is formed of a rubber layer so as to produce a frictional force between the belt 32 and the second roller 36. Preferably, this rubber is heat-resistant silicon rubber. The hardness of the rubber is from 20 to 70 degree and is preferably from 20 to 40 degree so as to acquire the frictional force with stability. There is nothing wrong with forming the first roller 35 of metal to its surface, but if its surface is formed of the same rubber layer as the second roller 36, the nip defined by the rollers is made flat in the direction of transfer to reduce the occurrence of curl of paper 41.

Belt stoppers 331, 341 that stop the respective belts 31, 32 from meandering are formed on both sides of the first belt guide 33 and the second belt guide 34, respectively. One end sides of the belt guide pressing springs 40 are mounted on the respective belt stoppers 331 mounted on both sides of the first belt guide 33 and the other end sides are fixed to the case of the fixing unit. The first belt guide 33 is pressed onto the second belt guide 34 by this belt guide pressing springs 40.

In a fixing operation, first, the respective belts 31, 32 are heated via the belt guides 33, 34 by heaters 37, 38 provided in the respective belt guides 33, 34. The second roller 36 is rotatively driven to carry (move) the second belt 32 to carry (move) the paper 41 by the frictional force of the second belt 32 and the paper 41. Toner 42 on the paper 41 is fixed to the paper 41 by the heat of the belts 31, 32 and the pressure between the belt guides 33, 34 and the pressure between the rollers 35, 36.

In this embodiment, the width N of the nip to press the paper 41 can be made wider than that of nip defined by the pair of rollers 35, 36 of the same diameter to ensure a time long enough to heat the toner even if a paper carrying speed is fast. Further, the width N of the nip can be made wider even when compared with a case where one belt is replaced by a roller. Still further, since the nip is flat in shape, the paper does not curl along the curvature of the roller.

When compared to a construction that each of the first belt 31 and the second belt 32 is looped over a pair of rollers, the belts 31, 32 are held loosely without having tension applied thereto. Hence, this can reduce the meandering force of the belts 31, 32 and prevent edge portions from being damaged by the meandering belts. Further, the number of rollers for carrying the belts 31, 32 is reduced by two, so that the heating parts are reduced in the heat capacity and the time required for the belts 31, 32 to reach a printable temperature capable can be shortened. Further, since the nip portion is pressed by the belt guides 33, 34, fixing capability can be improved and if a paper carrying speed is the same, fixing can be performed in a relatively narrower width of the nip or at a relatively lower temperature.

According to the features described above, when the fixing unit is constructed of a belt having the same diameter as the conventional belt, the fixing unit can respond to a faster paper carrying speed and increases a print speed per unit time. When the paper carrying speed is the same, the fixing unit can be constructed of a belt having a smaller diameter and hence can be reduced in size and can shorten the time required for the belt to reach a printable temperature.

Further, the embodiment has a construction having a driving system for driving only the second roller 36, but a construction having a driving system for driving also the first roller 35 at the same peripheral speed also produces the same effect. In a case where each of the rollers 35, 36 has a driving system in this manner, even if the surfaces of the roller get dirty and decrease in a coefficient of friction because of an extended period of operation, the belt carrying speed becomes stable, so that there is also produced an effect that the fixing unit can be used for the extended period.

Figure 4:
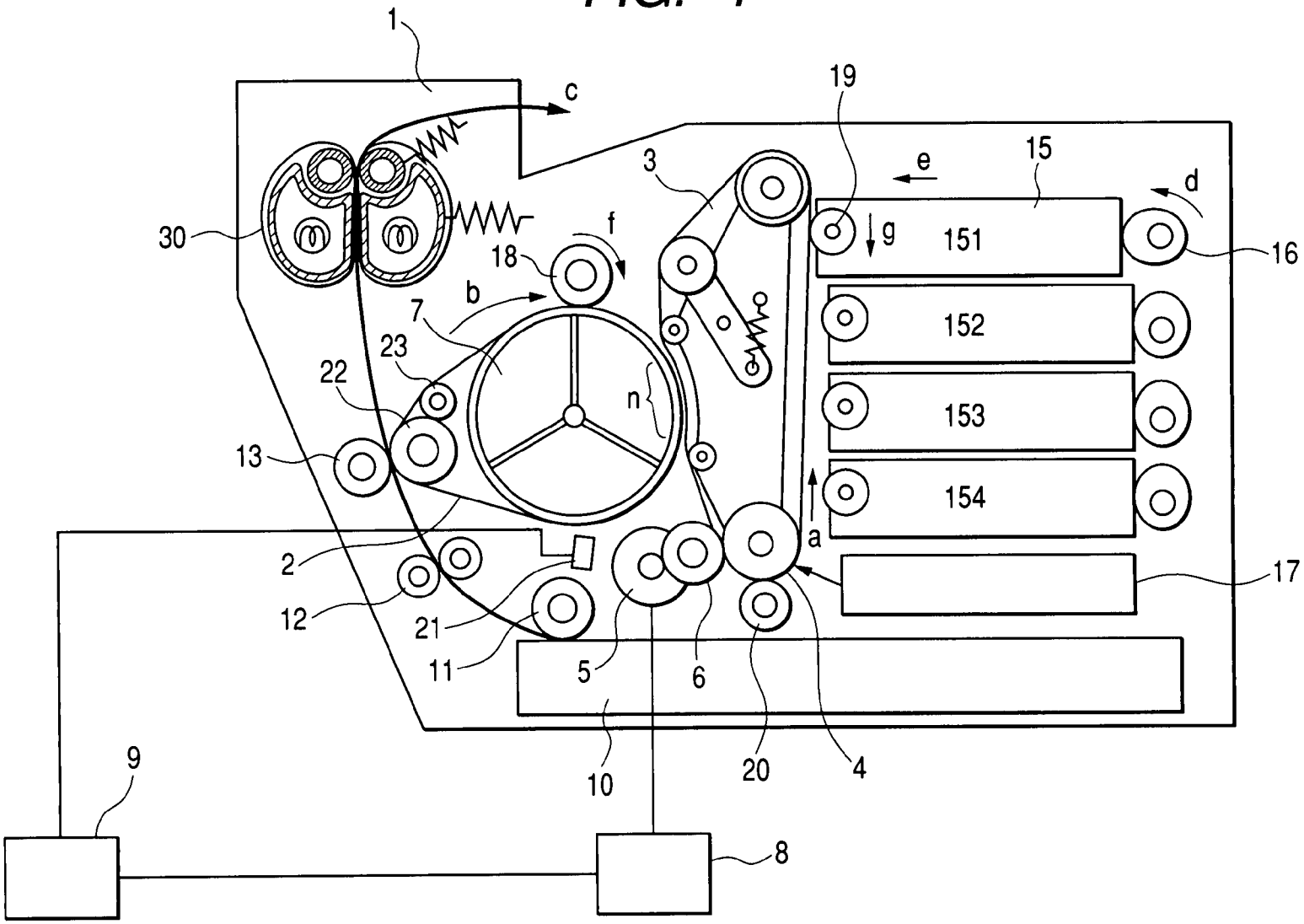
FIG. 4 is a side view of an image forming device using the fixing unit of the embodiment of the invention.

FIG. 4 is a side view of an example of an image forming device using the fixing unit of the first embodiment of the invention. This device is a color laser printer capable of forming a color image by superimposing four color images by rotating an intermediate transfer belt 2 four rotations.

Hereafter, the respective units arranged in an image forming device 1 will be described. A photosensitive belt 3 is looped under a tension longitudinally in the direction of gravity and is carried in the direction of arrow a by a photosensitive belt driving roller 4 driven via a motor driving system 6 by a drive motor 5. The intermediate transfer belt 2 is driven and carried by the carrying force of a nip portion n in contact with the photosensitive belt 3.

The photosensitive belt 3 is one in which a conductive layer and a photosensitive layer are formed on a base material of resin such as polycarbonate, polyethylene terephthalate, and polyimide. Its thickness is 0.075 to 0.15 mm. The intermediate transfer belt 2 is a seamless belt made of resin such as polycarbonate, polyethylene terephthalate, and polyimide, and is formed into a semiconductor so as to transfer toner and has a volume resitivity of $10^8$ to $10^{11}$ Ω·cm. The thickness of the intermediate transfer belt 2 ranges from 0.075 mm to 0.15 mm.

The intermediate transfer belt 2 is looped over a photosensitive belt side roller 7 and a transfer side roller 22 and the photosensitive belt 3 is wound via the intermediate transfer belt 2 around the photosensitive side roller 7. Here, the intermediate transfer belt 2 is arranged across the photosensitive belt 3 on the opposite side to developing units 15.

The photosensitive belt side roller 7 has a large diameter and the width of the nip defined by the photosensitive belt side roller 7 and the photosensitive belt 3 is made at least 20 mm or more and the transfer side roller 22 has a diameter smaller than the photosensitive side roller 7. An intermediate transfer belt tension roller 23 is means for applying tension to the intermediate transfer belt 2 and presses the intermediate transfer belt 2 by a spring or the like to apply tension to the intermediate transfer belt 2. The drive motor 5 is controlled in such a way as to keep the constant number of revolutions by a motor driver 8. The intermediate transfer belt 2 has a marker placed on its surface and a sensor 21 detects the passage of the marker. A computation means 9 reads the signal of the sensor 21 and instructs the motor driver 8 to carry the intermediate transfer belt 2 at a predetermined period.

A plurality of developing units 15 of image forming means are arranged in layers on the nearly vertical surface of the photosensitive belt 3. Each developing unit 15 stores toner and forms the toner in a thin layer on a developing roller 19. When a toner image is formed on the photosensitive belt 3, retracting means 16 is rotated in the direction of arrow d to advance the developing unit 15 in the direction of arrow e to bring the developing roller 19 into contact with the photosensitive belt 3. After an image is formed, the retracting means 16 is further rotated in the direction of arrow d to retract the developing unit 15. After an image on the intermediate transfer belt 2 is transferred to the paper, a fur brush 18 of erasing means is brought into contact with the intermediate transfer belt 2 by retracting means (not shown) to remove remaining toner and then is retracted from the intermediate transfer belt 2.

A transfer roller 13 of transfer means presses the paper onto the intermediate transfer belt 2 in a transfer process by retracting means (not shown) and is retracted after the paper passes by the transfer roller 13. A paper cassette 10 for stacking the sheets of paper is arranged nearly horizontally on the installation plane of the device in the lower portion of the device. The paper cassette 10, a pickup roller 11, a resist roller 12, a transfer roller 13, and the fixing unit 30 are arranged on a paper carrying path c. The paper carrying path c, the intermediate transfer belt 2, the photosensitive belt 3, and the developing units 15 are arranged in this order in the horizontal direction on the installation plane in the device.

Next, a process for forming an image will be described.

In the case of forming an image, the photosensitive layer of the photosensitive belt 3 is charged with a charging brush 20 and laser light responsive to the image is applied to the photosensitive layer from a laser optical unit 17 to remove electric potential. The developing roller 19 having toner attached thereto of the developing unit 15 is brought into contact with the photosensitive belt 3 while being rotated to form a toner layer responsive to the image on the photosensitive belt 3.

In this embodiment, in order to form a uniform toner image, the direction of rotation of the developing roller 19 is the direction of arrow g, that is, the same direction on the contact surface with the photosensitive belt 3 and the peripheral speed of the developing roller 19 is made faster than that of the photosensitive belt 3. The toner layer on the photosensitive belt 3 is once transferred to the intermediate transfer belt 2. A color laser printer has four developing units 151, 152, 153, 154 of four colors of black, yellow, magenta, and cyan and images formed on the photosensitive belt 3 by the respective colors are superimposed on the intermediate transfer belt 2 to form a color image.

The sheets of paper stored in the paper cassette 10 are carried off one by one by a pickup roller 11 and are corrected for skew by a resist roller 12. Immediately before the top of the paper reaches between the transfer roller 13 and the intermediate transfer belt 2, retracting means (not shown) presses the transfer roller 13 onto the intermediate transfer belt 2 to press the paper onto the intermediate transfer belt 2. At this time, the transfer roller 13 has high voltage applied thereto and transfers the toner image on the intermediate transfer belt 2 to the paper.

Thereafter, the paper reaches the fixing unit 30 where the toner image on the paper is fixed by the heat and pressure of the fixing unit 30. The fur brush 18 is brought into contact with the intermediate transfer belt 2 and is rotated to remove the image left on the intermediate transfer belt 2 after the image is transferred. To improve an image erasing ability, in this embodiment, the direction of rotation of the brush 18 is the direction of arrow f which is opposite to the direction b of rotation of the intermediate transfer belt 2.

Figure 5:
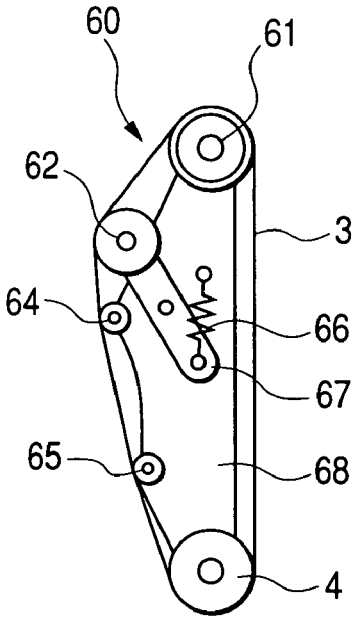
FIG. 5 is an illustration to show the construction of a photosensitive belt unit of the image forming device using the fixing unit of the embodiment of the invention.

FIG. 5 is an illustration to show the construction of a photosensitive belt unit of the image forming device using the fixing unit of the invention.

The photosensitive belt 3 is looped over a photosensitive belt driving roller 4, a photosensitive belt tension roller 62, and a driven roller 61. The photosensitive belt tension roller 62 applies tension to the photosensitive belt 3 by a spring 66 and a tension arm 67. The first auxiliary roller 64 and the second auxiliary roller 65 define the width of the nip defined by the intermediate transfer belt 2 and the photosensitive belt 3. These are arranged as a photosensitive belt unit 60 on a photosensitive belt unit frame 68.

Figure 6:
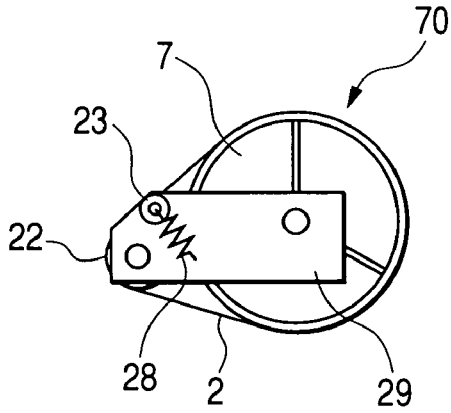
FIG. 6 is an illustration to show the construction of an intermediate transfer belt unit of the image forming device using the fixing unit of the embodiment of the invention.

FIG. 6 is an illustration to show the construction of the intermediate transfer belt unit of the image forming device using the fixing unit of the invention. The intermediate transfer belt 2 is looped over the photosensitive belt side roller 7 and the transfer side roller 22 and an intermediate transfer belt tension roller 23 is pushed up by a spring 28 to apply tension to the intermediate transfer belt 2. These are arranged as an intermediate transfer belt unit 70 on an intermediate transfer belt unit frame 29.

The image forming device of this embodiment can shorten the time that elapses after power is turned on until the fixing unit reaches a fixable temperature and the rise time that elapses before the device becomes printable. Further, the image forming device can increase a sheet carrying speed at the time of fixing and hence can print images at high speeds.

(Embodiment 2)

Figure 7:
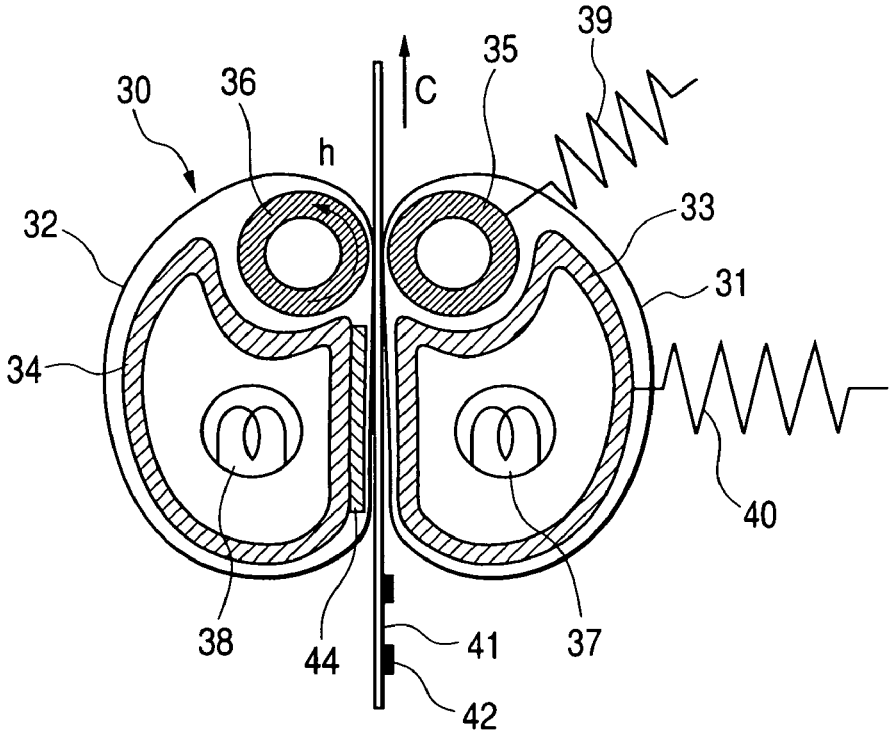
FIG. 7 is a sectional view of a fixing unit of the second embodiment of the invention.

FIG. 7 is a sectional view of a fixing unit of the second embodiment of the invention.

In this embodiment, a sliding sheet 44 is arranged at least at the nip of the second belt guide 34 and the second belt 32 and the surface of the first belt guide 33 is coated with a lubricant. Preferably, the sliding sheet 44 is cloth formed of a fluorine base resin plate or fluorine base fibers having a low coefficient of friction. With this construction, the carrying resistance of each belt is reduced to reduce the driving load of the fixing unit 30, whereby the fixing unit 30 can be driven by a smaller motor. Further, the lubricant on the surface of the first belt guide 33 reduces the carrying resistance of the belt and improves the thermal conductivity between the first belt guide 33 and the first belt 31 and hence produces an effect of shortening the time that elapses until the surface of the belt reaches a printable temperature.

(Embodiment 3)

Figure 8:
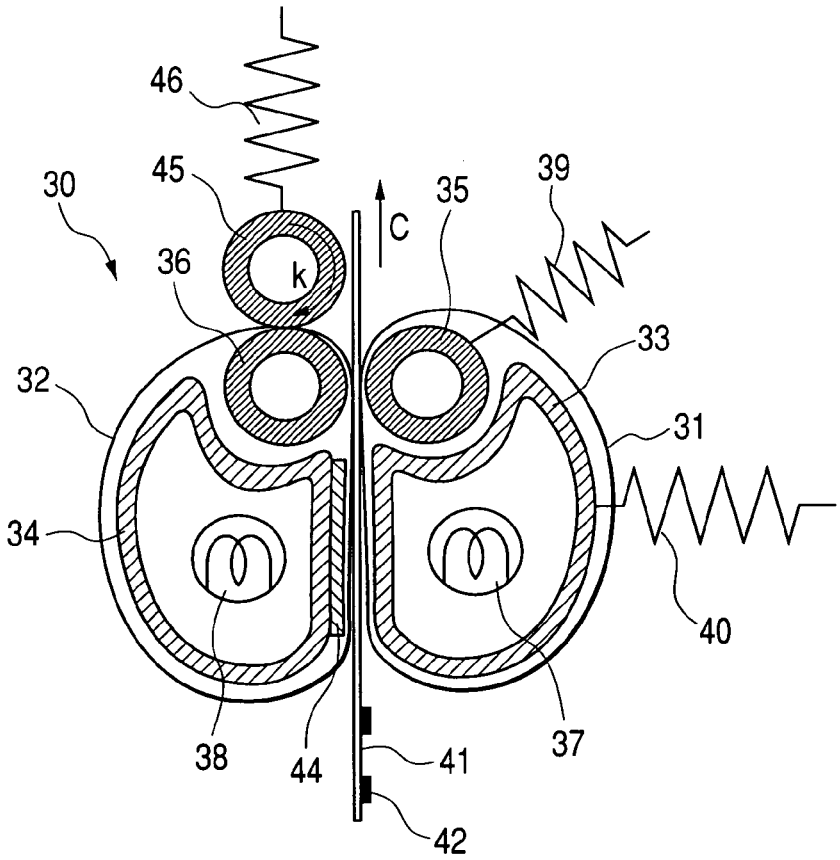
FIG. 8 is a sectional view of a fixing unit of the third embodiment of the invention.

FIG. 8 is a sectional view of a fixing unit of the third embodiment of the invention.

In this embodiment, the third roller is opposed via the second belt 32 to the second roller 36 and is pressed onto the second roller 36 by a second roller pressing spring 46. The third roller is rotated in the direction of arrow k in the drawing to carry the second belt 32. Since the second belt 32 is carried on the surface of the second belt 32, the surface of the second belt guide 34 can be coated with a lubricant to reduce the driving load of the fixing unit 30, whereby the fixing unit 30 can be driven by a smaller motor.

(Embodiment 4)

Figure 9:
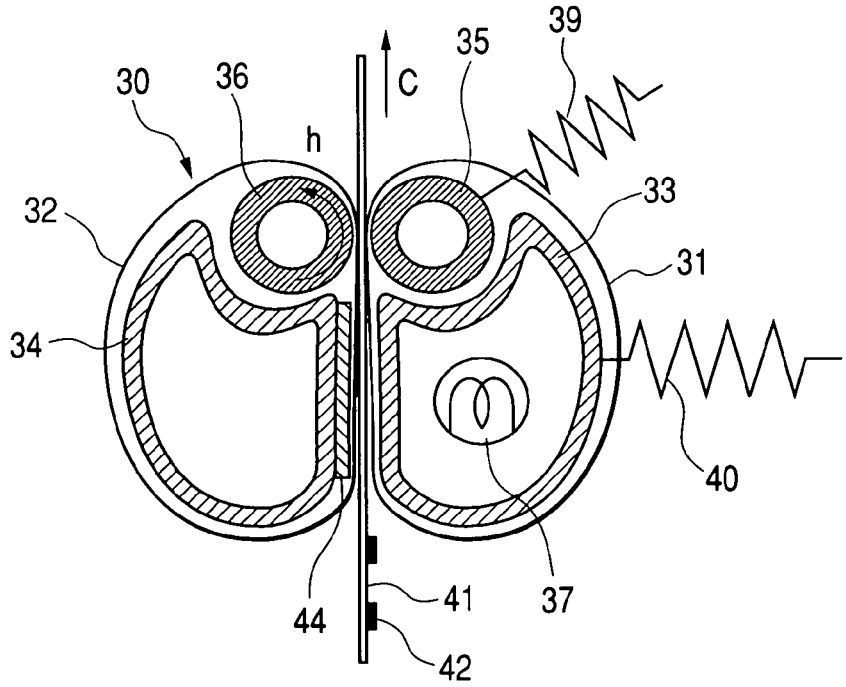
FIG. 9 is a sectional view of a fixing unit of the fourth embodiment of the invention.

FIG. 9 is a sectional view of a fixing unit of the fourth embodiment of the invention.

In this embodiment, a toner image side is heated only by the first heater 37. The second belt guide 34 is formed of a heat insulator having a low thermal conductivity such as heat-resistant resin or the like to make heat on the surface of the heating-side first belt 31 resist escaping. This construction is a simple construction having a single heater, and can reduce wasted heat to improve heating efficiency by forming the second belt guide 34 of a heat insulator, thereby reducing power consumption as a unit.

What is claimed is:

1. A fixing unit, comprising:

two belts;

belt guides each of which is arranged on an inner periphery side of each of the belts and guides an inner periphery of each of the belts;

a heating member arranged in at least one of the belt guides;

a drive roller that is arranged on an inner periphery side of one of the belts and drives the belt; and a driven roller that is arranged on an inner periphery side of the other belt and transfers a driving force of the drive roller to the other belt, wherein each of the belt guides is formed in a shape in which a paper pinching side and a side opposite to the paper pinching side of each of the belt guides come into contact with the inner periphery of each of the belts, and the paper pinching side of each of the belt guides is formed nearly in a flat plane shape.

2. The fixing unit as claimed in claim 1, wherein a toner image side of the paper faces the driven roller, the heating member is arranged in the belt guide of the driven roller, and the belt guide of the driven roller is formed of metal, further comprising a sliding member arranged at least at a paper pinching portion on a side in contact with the belt of the belt guide of the drive roller.

3. A fixing unit, comprising:

two belts;

belt guides each of which guides an inner periphery of each of the belts; and a heating member arranged in one of the belts or heating members arranged in both of the belts;

wherein driven rollers are provided on inner peripheral sides of the respective belts, and a drive roller that is brought into contact with one of the driven rollers via the belt to apply a driving force to the driven roller is provided on an outer peripheral side of the belt.

4. The fixing unit as claimed in claim 3, wherein the heating member is provided in the belt guide of the belt provided with only the driven roller.

5. The fixing unit as claimed in claim 4, wherein the belt guide is formed in such a shape as to come in contact with the whole inner periphery of the belt except for a portion where the driven roller is provided, and a paper pinching side of each of the belt guides is formed nearly in a flat plane shape.

6. An image forming device in which a plurality of developing units are arranged in layers on a surface nearly in a vertical direction of a photosensitive belt looped under a tension in a longitudinal direction, in which an intermediate transfer belt is arranged in such a manner as to abut against a surface opposite to the developing units of the photosensitive belt, in which a transfer roller is arranged at a position opposite to the photosensitive belt of the intermediate transfer belt, and in which a color toner image on the intermediate transfer belt is transferred to paper by the transfer roller, and having a fixing unit that passes the paper having the toner image transferred thereto to fix the toner image on the paper, wherein the fixing unit comprises:

two belts;

belt guides each of which is arranged on an inner periphery side of each of the belts and guides an inner periphery of each of the belts;

a heating member arranged in one of the belts or heating members arranged in both of the belts;

a drive roller that is arranged on an inner periphery side of one of the belts and drives the belt; and a driven roller that is arranged on an inner periphery side of the other belt and transfers a driving force of the drive roller to the other belt, each of the belt guides being formed in a shape in which a paper pinching side and a side opposite to the paper pinching side of each of the belt guides come into contact with the inner periphery of each of the belts, the paper pinching side of each of the belt guides being formed nearly in a flat plane shape.

7. The image forming device as claimed in claim 6, wherein a toner image side of the paper faces the driven roller, the heating member is arranged in the belt guide of a driven roller, the belt guide of the driven roller is formed of metal, and the fixing unit further comprises a sliding member arranged at least at a paper pinching portion on a side in contact with the belt of the belt guide of the driven roller.

8. A heat fixing unit comprising:

a first belt;

a second belt;

a second belt guide arranged to guide an inner periphery of the second belt;

a drive roller arranged on the inner periphery of the first belt to drive the first belt;

a driven roller arranged on the inner periphery of the second belt to transfer a driving force from the drive roller to the second belt;

a heating member arranged within at least one of the first and second belt guides;

wherein each of the belt guides is formed in a shape in which both a paper pinching side and a side opposite to the paper pinching side contact substantially all of the inner periphery of the belt except where the drive roller and the driven roller are provided; and the paper pinching side of each of the belt guides provides a substantially planar surface.

9. A heat fixing unit according to claim 8 wherein:

the paper passes through the fixing unit with the toner side facing the driven roller;

the heating member is arranged in the second belt guide;

the second belt guide comprises metal; and including a sliding member arranged at least with a paper pinching portion on a side in contact with the first belt.

10. A heat fixing unit according to claim 8 wherein:

the heating member is positioned within one of the first and second belt guides;

the belt guide within which the heating member is positioned comprises metal; and a low friction member is positioned between the other belt guide and the belt associated with that belt guide in at least a portion of the substantially planar surface.

11. A heat fixing unit according to claim 8 wherein a heating member is provided within each of the first and second belt guides.

12. A heat fixing unit according to claim 8 wherein a spring force is applied to the driven roller and to the second belt guide to press them into contact with the second belt and thereby to press the second belt into contact with the first belt.

13. A heat fixing unit according to claim 8 wherein the heating member is provided in the belt guide of only the driven roller.

14. A heat fixing unit according to claim 8 wherein the heating member is positioned within only one of the first and the second belt guides, and the other of the first and second belt guides comprises a thermal insulator.

15. In an image forming device in which a plurality of developing units are substantially vertically arranged to selectively contact a photosensitive belt, in which an intermediate transfer belt is arranged to abut the photosensitive belt, in which a transfer roller is arranged in contact with the intermediate transfer belt, and in which a color toner image on the intermediate transfer belt is transferred to paper by the transfer roller, the device including a heat fixing unit that fixes the color toner image to the paper, wherein the heat fixing unit comprises:

a first belt;

a second belt;

a first belt guide arranged to guide an inner periphery of the first belt;

a second belt guide arranged to guide an inner periphery of the second belt;

a drive roller arranged on the inner periphery of the first belt to drive the first belt;

a driven roller arranged on the inner periphery of the second belt to transfer a driving force from the drive roller to the second belt;

a heating member arranged within at least one of the first and second belt guides;

wherein each of the belt guides is formed in a shape in which both a paper pinching side and a side opposite to the paper pinching side contact substantially all of the inner periphery of the belt except where the drive roller and the driven roller are provided; and the paper pinching side of each of the belt guides provides a substantially planar surface.

16. An image forming device as in claim 15 wherein:

the paper passes through the fixing unit with the toner side facing the driven roller;

the heating member is arranged in the second belt guide;

the second belt guide comprises metal; and including a sliding member arranged at least with a paper pinching portion on a side in contact with the first belt.

17. An image forming device as in claim 15 wherein:

the heating member is positioned within one of the first and second belt guides;

the belt guide within which the heating member is positioned comprises metal; and a low friction member is positioned between the other belt guide and the belt associated with that belt guide in at least a portion of the substantially planar surface.

18. An image forming device as in claim 15 wherein a heating member is provided within each of the first and second belt guides.

19. An image forming device as in claim 15 wherein a spring force is applied to the driven roller and to the second belt guide to press them into contact with the second belt and thereby to press the second belt into contact with the first belt.

20. An image forming device as in claim 15 wherein the heating member is provided in the belt guide of only the driven roller.

21. An image forming device as in claim 15 wherein the heating member is positioned within only one of the first and the second belt guides, and the other of the first and second belt guides comprises a thermal insulator.

* * * * *